US005419404A

United States Patent [19]

Niemi et al.

[11] Patent Number: 5,419,404

[45] Date of Patent: May 30, 1995

[54] HYDRAULIC IMPACT HAMMER

[75] Inventors: Ilkka Niemi; Timo Sippus, both of Hollola, Finland

[73] Assignee: Bretec Oy, Lahti, Finland

[21] Appl. No.: 233,895

[22] Filed: Apr. 26, 1994

Related U.S. Application Data

[63] Continuation of Ser. No. 952,909, Nov. 17, 1992, abandoned.

[30] Foreign Application Priority Data

May 23, 1990 [FI] Finland ..... 902568

[51] Int. Cl.[6] ..... B25D 17/11

[52] U.S. Cl. ..... 173/171; 173/162.1; 173/DIG. 2; 181/230

[58] Field of Search ..... 173/DIG. 2, 162.1, 162, 173/171, 210; 181/230

[56] References Cited

U.S. PATENT DOCUMENTS

| | | | |
|---|---|---|---|
| 1,115,704 | 11/1914 | Manes | 181/230 |
| 2,949,975 | 8/1960 | Plummer | 173/DIG. 2 X |
| 3,757,875 | 9/1973 | Gunning | 173/DIG. 2 X |
| 3,815,705 | 6/1974 | Bennett | 181/230 |
| 4,327,807 | 5/1982 | Emonet | 173/DIG. 2 X |
| 4,624,339 | 11/1986 | Marcel et al. | 173/DIG. 2 X |
| 5,052,499 | 10/1991 | Dobry et al. | 173/162.1 X |
| 5,102,200 | 4/1992 | Woody | 173/162.1 X |

FOREIGN PATENT DOCUMENTS

| | | | |
|---|---|---|---|
| 144282 | 6/1985 | European Pat. Off. . | |
| 1006810 | 4/1957 | Germany . | |
| 2237528 | 5/1991 | United Kingdom | 173/DIG. 2 |

*Primary Examiner*—Rinaldi I. Rada
*Attorney, Agent, or Firm*—Smith-Hill and Bedell

[57] ABSTRACT

The invention relates to a hydraulic impact hammer, comprising a protective casing made of two side plates, and provided with attenuation elements for eliminating the noise and vibration caused by the impact hammer. According to the invention, the attenuation elements (5, 6) are arranged in the side plates (1, 2) of the protective casing, so that the attenuation elements (5, 6) can be compressed in at least three directions (X, Y, Z) of the housing (4) while fastening the side plates (1, 2) to each other.

7 Claims, 2 Drawing Sheets

HYDRAULIC IMPACT HAMMER

This is a continuation of U.S. National application Ser. No. 07/952,909 deposited Nov. 17, 1992 as entry into the national phase in the United States of International Application No. PCT/FI91/00143 filed May 7, 1991, the United States national application being now abandoned.

BACKGROUND OF THE INVENTION

The present invention relates to an impact hammer, particularly to the noise attenuation of a hydraulic hammer, so that the structure-borne noise is insulated in between the impact member and the side plates of the impact hammer.

A hydraulic hammer is used for instance in breaking frozen earth's crust, or in tunnel extraction in areas where the earth is softer than the bedrock. The practical applications of the hydraulic hammer lead to the fact that while using the hammer, the created noise causes problems to the environment, and particularly to the users of the hammer. Therefore various solutions have been suggested for reducing noise. One of the suggested arrangements comprises vibration-restricting rubber bits in between the protective casing and the impact member, which bits are installed in longitudinal direction with respect to the axis of the impact member. The rubber bits are so shaped that one part thereof is attached to the protective casing and the other part to the impact member. Thus the rubber bits are subjected to relatively great shearing strengths during the impact stroke, and consequently the working life of such rubber bits cannot be very long.

From the EP patent 144,282 there is known a hydraulic impact hammer where separate attenuation elements are used for eliminating noise during the use of the hammer. The attenuation elements are made of some elastic material. In order to install these attenuation elements, the protective casing of the hammer must be provided with special installation openings, or the impact member must be fitted within oversized attenuation elements. Thus the installation of the attenuation elements is cumbersome and requires special tools. Moreover, while using the hammer, bending strains are directed to the protective casing, so that the bending also causes defective extra strain to the hammer housing.

The EP patent 191,336 describes a hydraulic impact hammer where the noise caused by the use of the hammer is reduced by means of the installation arrangements of the working unit. A special feature of the hammer is that the employed attenuation elements are arranged transversally with respect to the axis of the impact member, around fastening bolts connecting the different parts of the protective casing. The employed attenuation elements are rubber collars, which, however, take up a lot of space and make the hammer rather large in size.

SUMMARY OF THE INVENTION

The object of the present invention is to eliminate some of the drawbacks of the prior art and to create a hydraulic impact hammer which is more ecological, structurally more durable and easier on its assembly and advantageous in size, with reduced noise and vibration, so that the structure-borne noise caused by the hammer can in all essential respects be insulated within a closed casing formed by side plates, in between the impact hammer and the side plates.

The casing of the hydraulic impact hammer of the invention is formed of two separate side plates, which are metallically interconnected for instance by means of a screw, a bolt or a catch joint. An attenuation element is supported against each side plate, so that the bottom part of the housing of the impact hammer remains in between the attenuation elements when the plates are attached to each other. Then a metallic contact between the impact hammer and the side plates can be advantageously avoided, and the noise caused by the operation of the hammer is essentially reduced.

In the impact hammer of the invention, the attenuation elements are located at the bottom part of the side plates, and their contact surfaces are shaped essentially to conform to the walls formed by the side plates of the hammer casing, so that when the side plates are connected to each other, the attenuation elements are wedged to remain compressed both in the longitudinal and the transversal direction of the impact hammer. Moreover, the bottom part of the housing of the hammer is pressed in the direction of the connecting members, with respect to the attenuation elements. Thus the impact hammer is easily supported at the bottom part of the housing, in three different directions at the attenuation elements, which means that strain is not directed to other parts of the hammer. At the same time it means, from the point of view of the operation of the hammer, that the vibration and noise of the hammer are essentially reduced.

The attenuation elements of the impact hammer of the invention are advantageously made of some elastic material, such as cellular polyurethane or rubber or some rubber compound. Thus the attenuation elements can easily be made oversized, so that when the side plates of the protective casing are fastened together, the attenuation elements are compressed by 15–40%, advantageously 20–30%, relative to their dimensions prior to the fastening of the side plates. While using an impact hammer, the moment strains directed to the attenuation elements are greater than the precompression, in which case the attenuation elements may be subjected to strains that exceed the elastic limit of the material, which possibly cuts the working life of the attenuation elements. Therefore there can, when necessary, be arranged restricting members in connection with the attenuation elements, which restricting members are advantageously made of metal. These restricting members receive the force when a predetermined maximum compression, which is 50–70% of the dimensions of the attenuation element prior to the fastening of the side plates, is exceeded.

In the impact hammer of the invention, an essentially good vibration and noise attenuation is achieved together with a light structure. The hammer also is easy to maintain, because the casing is formed of two parts, which are interconnected with simple connecting members. Moreover, the working life of the attenuation elements can be extended by using restricting members, which prevent the predetermined maximum compression of the attenuation elements from being surpassed. By means of the attenuation elements, the bottom part of the impact hammer is easily supported, which essentially prevents any extra forces against the housing of the hammer for instance when the casing is being bent.

BRIEF DESCRIPTION OF THE DRAWINGS

The invention is explained in more detail below, with reference to the appended drawing where.

DETAILED DESCRIPTION

Figure 1:
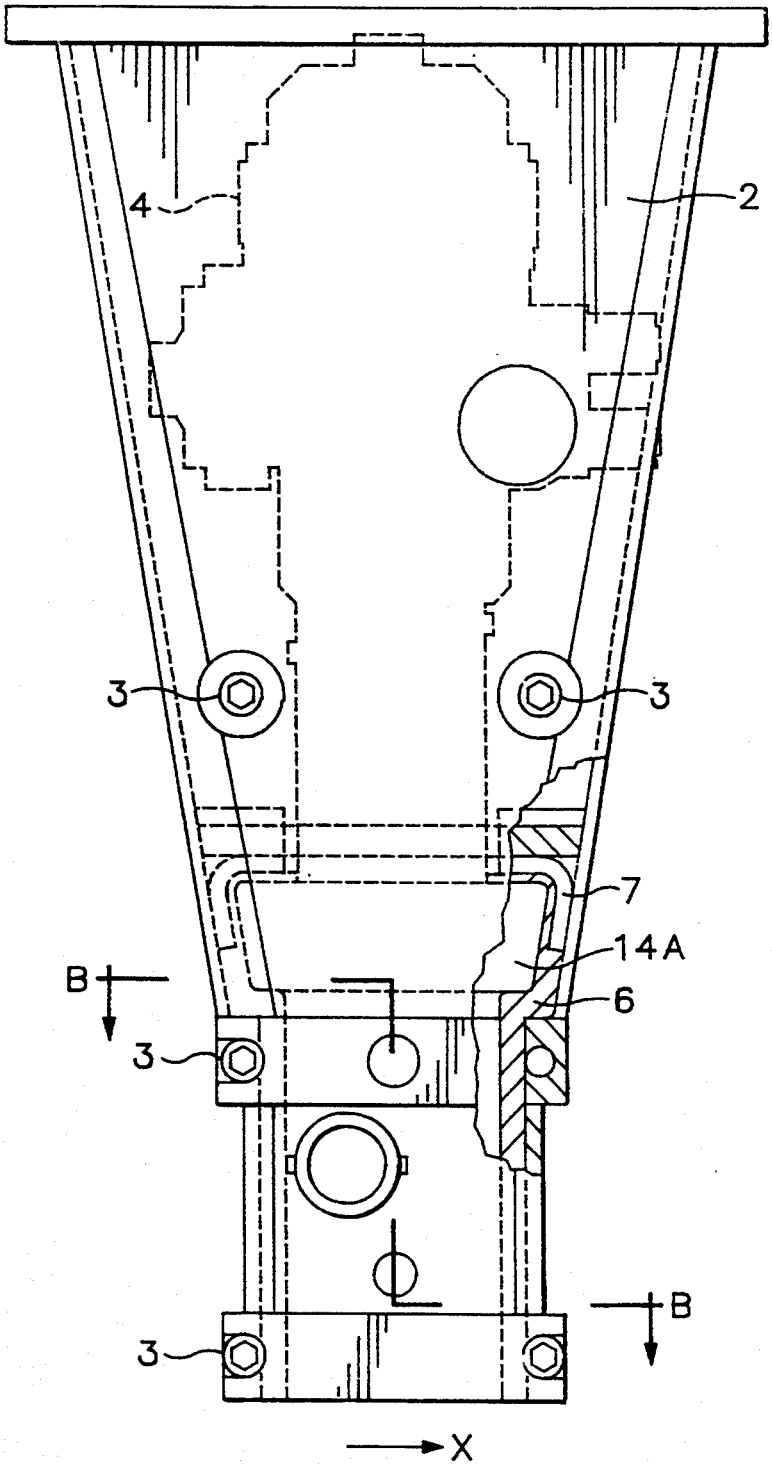
FIG. 1 illustrates a preferred embodiment of the invention, seen in a partial side-view cross-section.
Figure 2:
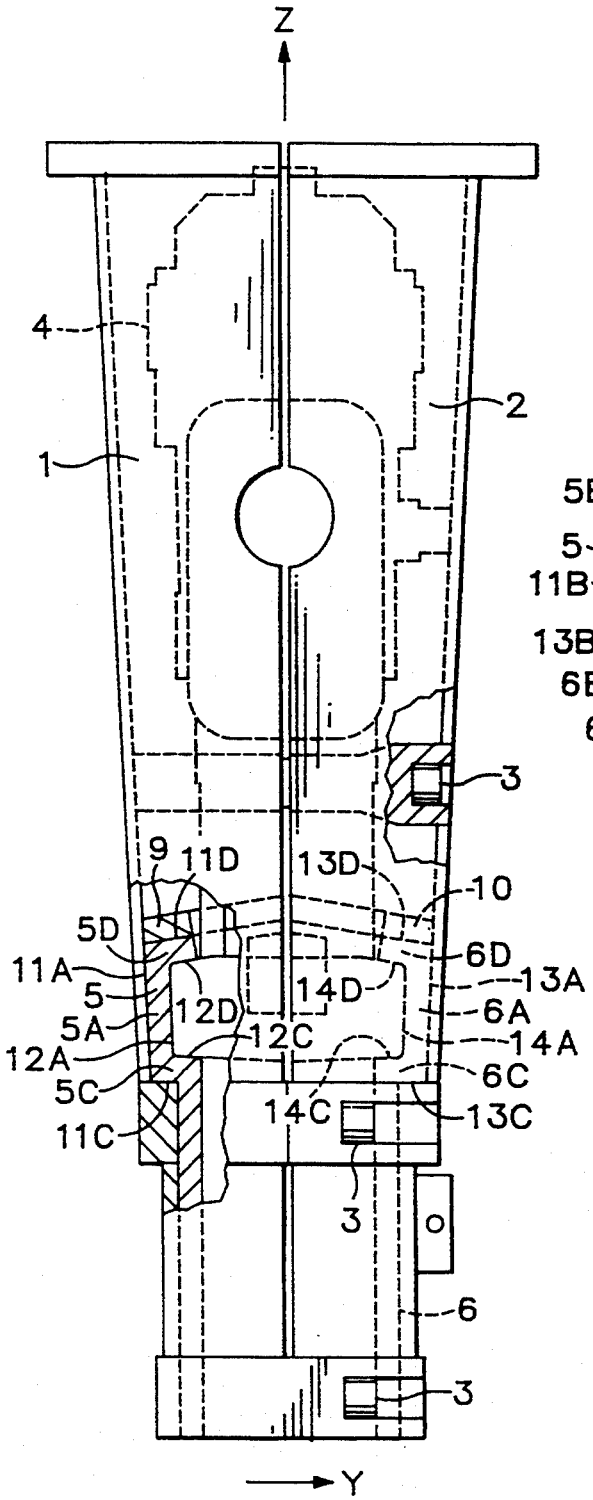
FIG. 2 represents a partial side-view cross-section the embodiment of FIG. 1, when the embodiment of FIG. 1 is turned 90° around the vertical axis.
Figure 3:
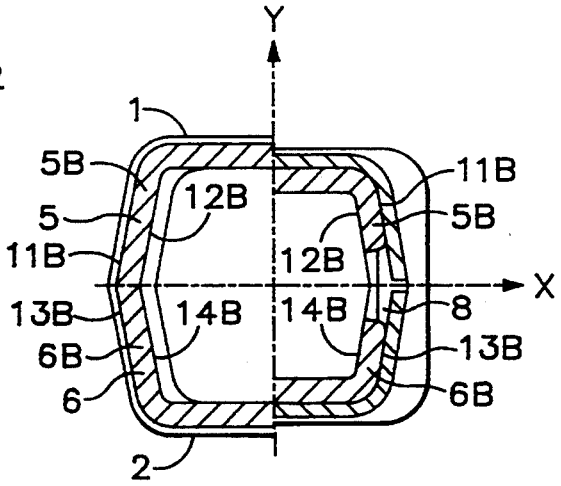
FIG. 3 illustrates the embodiment of FIG. 1, seen from the direction B—B.

In the drawing the protective casing of the impact hammer is formed of two side plates 1 and 2, which can be attached to each other by means of the screws 3. In addition to this, the housing of the impact hammer is indicated in FIGS. 1 and 2 by the dotted line 4. The side plates 1 and 2 are provided with respective abutment plates 9 and 10. At the bottom part of the housing 4 of the hammer, in the side plates 1 and 2, there are provided the attenuation elements 5 and 6. Attenuation elements 5, 6 include portions 5A, 6A; 5B, 6B; 5C, 6C; and 5D, 6D. The portions 5A, 6A are located between the surfaces 11A, 13A of the side plates 1 and 2 respectively and the surfaces 12A, 14A of the impact hammer 4. The surfaces 11A–14B are transverse to the X-Y plane. When the side plates 1 and 2 are attached to each other by means of the screws 3, the portions 5A and 6A are compressed in the transversal direction Y of the housing 4, between the side plates and the impact hammer. The portions 5B, 6B are located between surfaces 11B, 13B of the side plates 1 and 2 respectively and the surfaces 12B, 14B of the impact hammer 4. The two surfaces 11B, at opposite respective sides of the Y-Z plane, converge in the direction away from the plane at which the side plates 1 and 2 meet, and similarly the two surfaces 12B converge in the direction away from the plane at which the side plates meet. Therefore, when the side plates are attached to each other by means of the screws 3, the portions 5B are compressed in the X direction. Similarly, the portions 6B are compressed between the surfaces 13B, 14B when the side plates are attached to each other. The portions 5C, 6C are located between surfaces 11C, 13C of the side plates 1 and 2 and the surfaces 12C, 14C of the impact hammer, and the portions 5D, 6D are located between the surfaces 11D, 13D of the abutment plates 9 and 10 and the surfaces 12D, 14D of the impact hammer. The two surfaces 11C and 11D converge in the direction away from the plane at which the side plates 1 and 2 meet, and similarly the two surfaces 12C and 12D converge in the direction away from the plane at which the side plates meet. Therefore, when the side plates are attached to each other by means of the screws 3, the portions 5C, 5D are compressed in the Z direction. Similarly, the portions 6C, 6D are compressed in the Z direction between the surfaces 13C, 14C and 13D, 14D when the side plates are attached to each other. In this manner, the attenuation elements are compressed in three directions. Thus the contact surfaces of the attenuation elements 5 and 6 advantageously and essentially conform to the side plates 1 and 2. FIGS. 1 and 3 also describe metallic restricting members 7 and 8, which serve as stops with respect to movement of the impact hammer relative to the side plates in the X direction. When the force in the X direction reaches a predetermined limit, the impact hammer engages the restricting members 7 and/or 8. The restricting members thus the attenuation elements 5 and 6 from being subjected to compressions greater than the predetermined maximum compression.

We claim:

1. A hydraulic impact hammer comprising:

a protective casing comprising two side plates each having an interior surface, and means for fastening the side plates together so that said interior surfaces bound a chamber, a hammer mechanism disposed in said chamber, and elastically deformable attenuation elements each having an exterior surface portion that substantially matches a confronting interior surface portion of at least one of the side plates, said attenuation elements being captive between the protective casing and the hammer mechanism and being in a state of compression in at least two directions.

2. An impact hammer according to claim 1, wherein the attenuation elements are made of polyurethane.

3. An impact hammer according to claim 1, wherein the attenuation elements are made of rubber or a rubber compound.

4. An impact hammer according to claim 1, wherein the attenuation elements are made of an elastomeric material and said state of compression is such that the attentuation elements are compressed by of 15–40 percent relative to their uncompressed state.

5. An impact hammer according to claim 1, wherein the hammer mechanism has a longitudinal direction and the attenuation elements are in a state of compression in two directions that are perpendicular to each other and to the longitudinal direction of the hammer mechanism.

6. An impact hammer according to claim 1, wherein the means for fastening the side plates together comprises a means for urging the side plates together along a predetermined axis, and the attenuation elements are in a state of compression in a direction parallel to said axis and in a direction perpendicular to said axis.

7. An impact hammer according to claim 1, wherein the attenuation elements are in a state of compression in three directions.

* * * * *